US005597339A

United States Patent [19]

Spector

[11] Patent Number: 5,597,339

[45] Date of Patent: Jan. 28, 1997

[54] STUFFED TOY FIGURE AND OFFSPRING ASSEMBLY

[76] Inventor: Donald Spector, 380 Mountain Rd., Union City, N.J. 07080

[21] Appl. No.: 550,173

[22] Filed: Oct. 30, 1995

[51] Int. Cl.[6] ..... A63H 3/06; A63H 3/02

[52] U.S. Cl. ..... 446/226; 446/369; 446/901; 473/273

[58] Field of Search ..... 446/72, 74, 220, 446/223, 226, 295, 296, 369, 371, 372, 268, 901; 434/273

[56] References Cited

U.S. PATENT DOCUMENTS

| | | | |
|---|---|---|---|
| 1,216,425 | 2/1917 | Eiseman | 446/226 |
| 1,543,351 | 6/1925 | Webb | 446/369 |
| 2,208,445 | 7/1940 | Bates | 446/223 X |
| 3,789,547 | 2/1974 | Chemarin | 446/369 |
| 4,197,670 | 4/1980 | Cox | 434/273 X |
| 4,296,567 | 10/1981 | Kamar | 446/369 |
| 5,129,853 | 7/1992 | Bowling | 446/296 X |

FOREIGN PATENT DOCUMENTS

| | | | |
|---|---|---|---|
| 1375573 | 9/1964 | France | 446/226 |
| 912716 | 12/1962 | United Kingdom | 446/226 |
| 2269113 | 2/1994 | United Kingdom | 446/369 |

*Primary Examiner*—Robert A. Hafer
*Assistant Examiner*—D. Neal Muir
*Attorney, Agent, or Firm*—Michael Ebert

[57] ABSTRACT

An animal-like stuffed toy figure most of whose body is covered with a simulated hairy fur of a character appropriate to the animal which the figure resembles. The body is provided with a closable internal pouch in which is received a latent offspring. The latent offspring is the collapsed state of a shaped ball formed by an outer casing covered with a fur corresponding to that of the figure and enclosing a deflated balloon whose neck projects through a port in the casing. When a player takes the latent offspring out of the pouch and inflates the balloon to expand the casing, the resultant offspring which has the same fur as the figure and, therefore, somewhat resembles the figure, can be played with as a ball.

7 Claims, 2 Drawing Sheets

STUFFED TOY FIGURE AND OFFSPRING ASSEMBLY

BACKGROUND OF INVENTION

1. Field of Invention

This invention relates generally to stuffed toy figures having an animal-like form, but more particularly to a figure of this type whose body is provided with a closable internal pouch in which is received, in a collapsed state a latent, offspring of the figure.

2. Status of Prior Art

It is known to provide a soft, stuffed toy figure having an animal-like form, the figure having an internal compartment adapted to receive and store various articles. Thus my prior U.S. Pat. No. 5,393,257 (Spector) discloses a monkey-like stuffed toy figure provided with an internal compartment having an audio-cassette player stored therein. And in the Stone U.S. Pat. No. 5,059,149, the stuffed toy figure is that of a Teddy Bear in whose internal body compartment are stored a children's book and other items. In these prior patents which disclose animal-like toy figures the items store in the figure bear no resemblance to the figure.

In an animal-like figure and offspring assembly in accordance with the invention, the latent offspring received in an internal pouch, though it bears some resemblance to the figure, is capable of functioning as a pneumatic ball of the type shown in my prior U.S. Pat. No. 4,834,382 (Spector).

My prior U.S. Pat. No. 4,834,382 discloses a pneumatic play ball that includes an outer casing of non-stretchable fabric material having a closable opening therein, the configuration of the casing depending on the nature of the ball. The casing encases an ordinary balloon of stretchable material which when unconfined is capable of being inflated to assume a generally globular form, the balloon having an air-passage stem. The balloon is inserted in its uninflated state into the casing through the opening, the stem then projecting out of the opening.

After the confined balloon is inflated by blowing air through its stem to cause the balloon to conform to the inner surface of the casing and to assume the same configuration, the stem is knotted to seal the balloon. The knotted stem is pushed under the opening which is then closed, whereby no portion of the encased balloon can be extruded from the casing when the ball bounces.

The term "offspring" as used in the context of the present invention which relates to animal-like toy figures, refers to the offspring of a pouched mammal, such as a kangaroo or other marsupial. In a pouched mammal a single young is born and is suckled in the mother's pouch for about six months. After it begins to graze, the offspring returns frequently to its mother's pouch for shelter and transportation until it is too large to be carried. In a stuffed toy figure in accordance with the invention, the figure includes an internal pouch in which is received a latent offspring, this being an offspring in a collapsed state.

SUMMARY OF INVENTION

In view of the foregoing, the main object of this invention is to provide a stuffed toy figure and offspring assembly in which a latent offspring in a collapsed state is received in an internal pouch in the body of the figure.

More particulary, an object of the invention is to provide an assembly of the above type in which the latent offspring, when taken out of the pouch and then inflated, then not only bears some resemblance to the figure, but also can be played with as a ball.

Yet another object of this invention is to provide an assembly which can be manufactured at relatively low cost.

Briefly stated, these objects are attained in an animal-like stuffed toy figure whose body is covered with a simulated hairy fur of a character appropriate to the animal which the figure resembles. The body is provided with a closable internal pouch in which is received a latent offspring.

The latent offspring is the collapsed state of a shaped ball formed by an outer casing covered with a fur corresponding to that of the figure, and enclosing a deflated balloon whose neck projects through a port in the casing. When a player takes the latent offspring out of the pouch and inflates the balloon to expand the casing, the resultant offspring which has the same fur as the figure and, therefore, somewhat resembles the figure, can be played with as a ball.

BRIEF DESCRIPTION OF INVENTION

For a better understanding of the invention, as well as other objects thereof, reference is made to the following detailed description to be read in conjunction with the accompanying drawings wherein.

DESCRIPTION OF INVENTION

Figure 1:
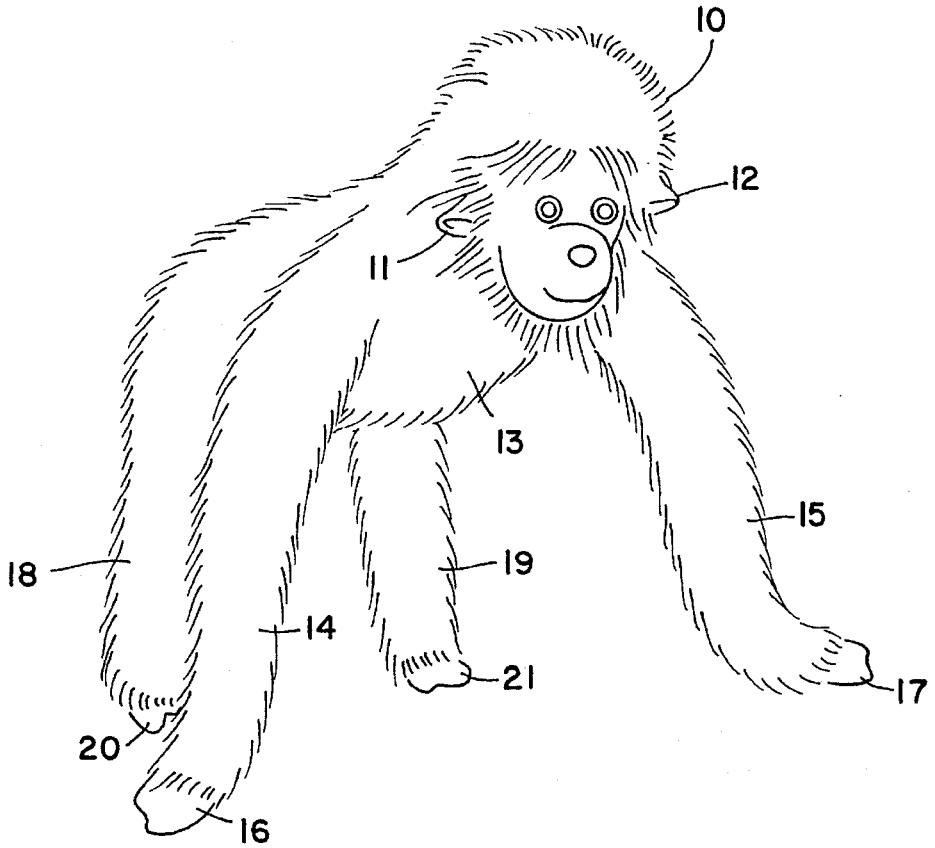
FIG. 1 is a front view of an animal-like toy figure in accordance with the invention.
Figure 3:
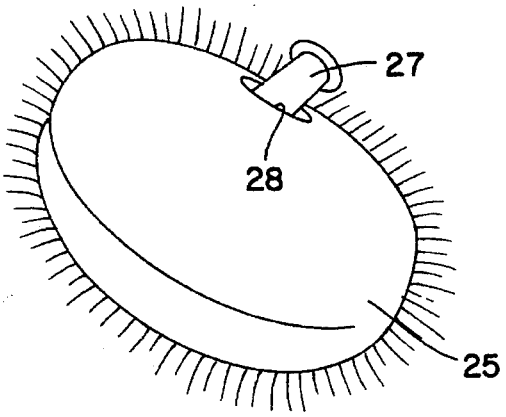
FIG. 3 shows, in its collapsed state, the latent offspring that is to be nested in the pouch.

Referring now to FIG. 1 there is shown in frontal view a soft, animal-like stuffed figure in accordance with the invention, the figure shown resembling a chimpanzee. This showing is by way of example only, for in practice other animal forms may be used, such as that of a bear.

The soft chimpanzee-like figure includes a head 10 formed of a fabric provided with simulated eyes, a nose and a mouth, as well as ears 11 and 12 projecting from opposite sides of the head. The figure further includes a torso 13 from whose shoulders extend a pair of long arms 14 and 15 terminating in fabric hands 16 and 17. Extending from the crotch of the torso are relatively short legs 18 and 19 terminating in fabric feet 20 and 21. Except from the head, the ears, the hands and the feet, the entire body of the figure is covered with a simulated fur having the very long hairs characteristic of a chimpanzee's fur. In practice the fur may have a pure white color, giving the chimpanzee a striking appearance.

Except for the simulated eyes and nose, the figure is entirely soft, and may be cuddled and otherwise manipulated by a child playing with the figure.

Figure 2:
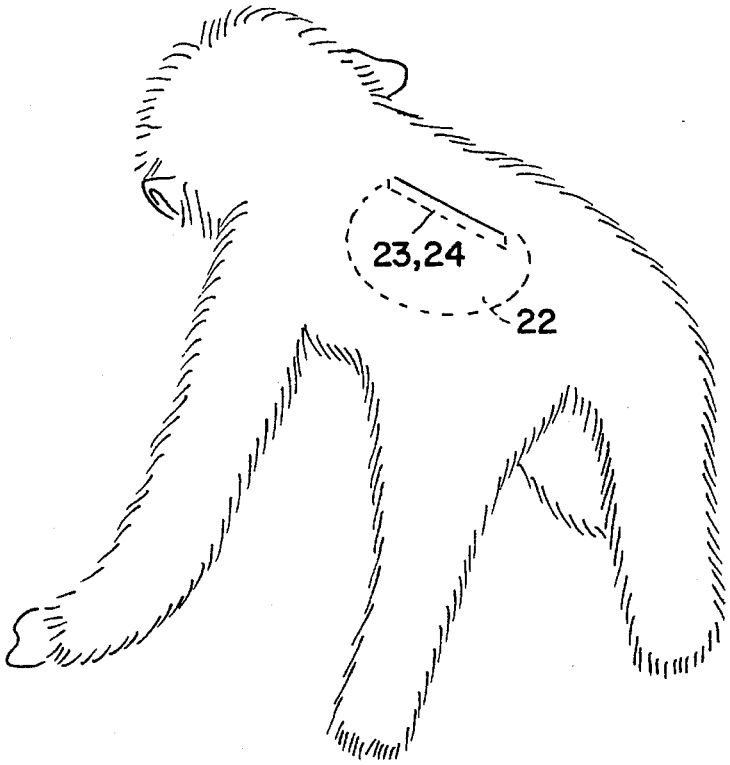
FIG. 2 is a rear view of this figure shows the internal pouch therein in its open state.

In the rear of the figure as shown in FIG. 2, in the torso region there is an internal pocket or pouch formed of a strong fabric, the opening of the pouch being provided with male and female Velcro (hook and loop) fastener tapes 23 and 24 so that the pouch can be closed. When the pouch is closed, the long hairs of the fur in the region adjacent the closure of the pouch conceal this closure so that there is nothing to indicate to an observer that the pouch exists.

Figure 4:
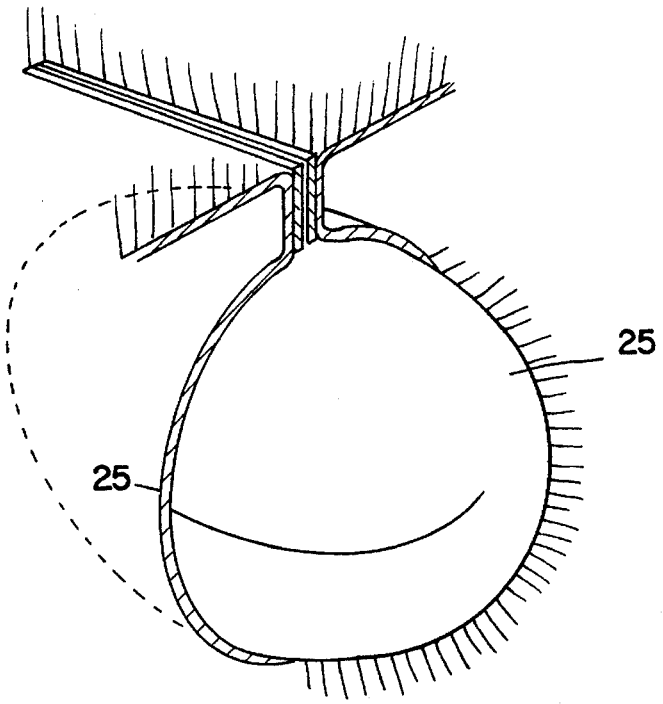
FIG. 4 is a separate view of the pouch with the latent offspring nested therein.

Received in the pouch in its collapsed state is a latent offspring, as shown in FIG. 4, which consists of a non-stretchable casing 25 fabricated of the same simulated fur material which covers the chimpanzee figure, the casing enclosing a deflated rubber balloon 26 whose air-inlet neck 27 projects through a port 28 in the casing, so that the balloon can be inflated.

The dimensions of internal pouch 22 are such as to accommodate the collapsed latent offspring when it is put into the pouch. Hence when the latent offspring is stuffed into the pouch 22 and the pouch is closed, there is nothing to indicate to an observer the existence of the pouch or of the latent offspring.

Figure 5:
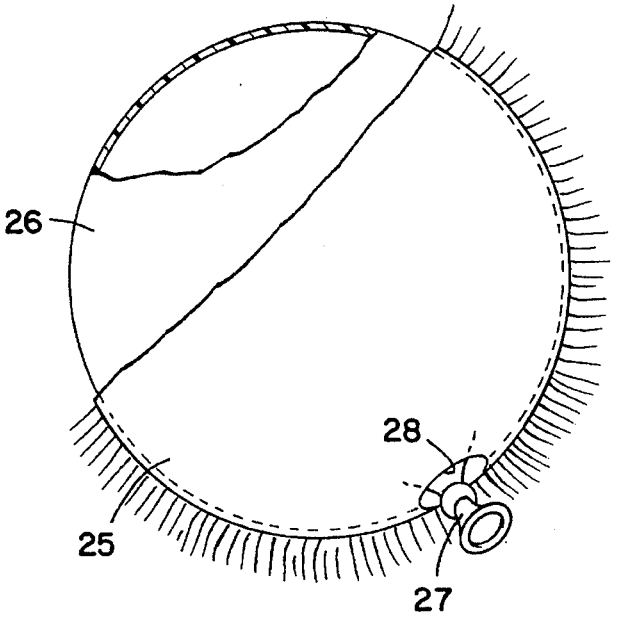
FIG. 5 shows, partly in section the latent offspring after it has been inflated to create a playball.

When, however, the latent offspring is taken out of the pouch and inflated, after which the neck of the balloon is knotted, and pushed under the port on the casing, then one has, as shown in FIG. 5, a pneumatic playball whose outer casing has the same fur as that of the chimpanzee figure and, therefore, appears to be the roly-poly offspring of the figure. One can play with or bounce the ball as one does with an ordinary ball. But at the end of play, the balloon may be pricked to deflate it and cause the casing to collapse so that it can be returned to the pouch and the latent offspring, as it were, stored in its mother.

Hence there is a family relationship between the pouched animal-like figure and the latent offspring stored in its pouch as there is between a pouched mammal and its young.

While there has been shown a preferred embodiment of a stuffed toy figure and offspring assembly in accordance with the invention, it will be appreciated that many changes may be made therein without departing from the spirit of the invention. Thus the casing need not be spherical but may be in other shapes. However, regardless of the shape of the case, the balloon when installed, will conform thereto. Instead of a figure of a chimpanzee, the figure may be that of a Teddy Bear having a brown fur, in which case the casing also has a brown fur covering.

I claim:

1. A toy figure and offspring assembly comprising:

A. a stuffed toy figure resembling a particular type of animal most of whose body is covered with a simulated hairy fur of a character appropriate to the figure, the body being provided with a closable internal pouch which when closed is then concealed by the hairy fur; and B. a single latent offspring receivable in the pouch in a collapsed state consisting of an outer spherical casing covered with a simulated fur which corresponds to that of the figure and a deflated balloon enclosed in the casing having a neck projecting through a port in the casing, the dimensions of the pouch being sufficient only to accommodate the offspring in the collapsed state whereby when the latent offspring is removed from the pouch and the balloon is inflated through its neck to expand the casing, after which the neck is tied, a furry playball is then produced which is a roly-poly offspring of the figure.

2. An assembly as set forth in claim 1, in which the figure resembles a chimpanzee having a torso, arms and legs, and said internal pouch is disposed in said torso.

3. An assembly as set forth in claim 2, in which the torso, the arms and the legs are stuffed.

4. An assembly as set forth in claim 1, in which said pouch is formed of fabric and is provided with an opening which is closable by a hook and loop fastener.

5. An assembly as set forth in claim 1, in which said offspring casing, when inflated, has spherical form.

6. An assembly as set forth in claim 1, in which the neck of the balloon, where it is tied to seal the balloon is then forced under the port in the casing.

7. An assembly as set forth in claim 1, in which the figure is that of a Teddy Bear having a brown fur, and said casing also has a brown fur.

* * * * *